US005895141A

United States Patent [19]

Budnik et al.

[11] Patent Number: 5,895,141

[45] Date of Patent: Apr. 20, 1999

[54] SENSORLESS TC CONTROL

[75] Inventors: Roger W. Budnik, Rochester; James M. Pacer, Webster; Guru B. Raj, Fairport; Ralph A. Shoemaker, Rochester; Michael G. Swales, Sodus, all of N.Y.

[73] Assignee: Xerox Corporation, Stanford, Conn.

[21] Appl. No.: 09/055,547

[22] Filed: Apr. 6, 1998

[51] Int. Cl.[6] ..... G03G 15/10

[52] U.S. Cl. ..... 399/58; 399/60

[58] Field of Search ..... 399/49, 29, 60, 399/58

[56] References Cited

U.S. PATENT DOCUMENTS

| | | | |
|---|---|---|---|
| 5,023,817 | 6/1991 | Au et al. | 364/550 |
| 5,038,319 | 8/1991 | Carter et al. | 395/181 |
| 5,057,866 | 10/1991 | Hill, Jr. et al. | 399/8 |
| 5,533,193 | 7/1996 | Roscoe | 395/183.15 |
| 5,666,588 | 9/1997 | Uchiyama et al. | 399/49 X |
| 5,784,667 | 7/1998 | Mestha et al. | 399/49 |

*Primary Examiner*—S. Lee
*Attorney, Agent, or Firm*—Ronald F. Chapuran

[57] ABSTRACT

A method to provide a highly intelligent, automated diagnostic system that identifies the need to replace specific parts to minimize machine downtime rather than require extensive service troubleshooting. In particular, a systematic, logical test analysis scheme to assess machine operation from a simple sensor system and to be able to pinpoint parts and components needing replacement is provided by a series of first level of tests by the control to monitor components for receiving a first level of data and by a series of second level of tests by the control to monitor components for receiving a second level of data. Each of the first level tests and first level data is capable of identifying a first level of part failure independent of any other test. Each of the second level tests and second level data is a combination of first level tests and first level data or a combination of a first level test and first level data and a third level test and third level data. The second level tests and second level data are capable of identifying second and third levels of part failure. Codes are stored and displayed to manifest specific part failures.

14 Claims, 12 Drawing Sheets

SENSORLESS TC CONTROL

BACKGROUND OF THE INVENTION

The invention relates to analysis of xerographic processes, and more particularly, to the precise determination of failed parts within the xerographic process.

As reproduction machines such as copiers and printers become more complex and versatile, the interface between the machine and the service representative must necessarily be expanded if full and efficient trouble shooting of the machine is to be realized. A suitable interface must not only provide the controls, displays, fault codes, and fault histories necessary to monitor and maintain the machine, but must do so in an efficient, relatively simple, and straightforward way. In addition, the machine must be capable of in depth self analysis and either automatic correction or specific identification of part failure to minimize service time.

Diagnostic methods often require that a service representative perform an analysis of the problem. For example, problems with paper movement in a machine can occur in different locations and occur because of various machine conditions or failure of various components. In the prior art, this analysis by the service representative has been assisted by recording fault histories in the machine control to be available for readout and analysis. For example, U.S. Pat. No. 5,023,817, assigned to the same assignee as the present invention, discloses a method for recording and displaying in a finite buffer, called a last 50 fault list, machine faults as well as fault trends or near fault conditions. This data is helpful in diagnosing a machine. It is also known in the prior art, to provide a much larger data log, known as an occurrence log, to record a variety of machine events.

In addition U.S. Pat. No. 5,023,817, assigned to the same assignee as the present invention, discloses a technique to diagnose a declared machine fault or a suspected machine fault by access to a library of fault analysis information and the option to enter fault codes to display potential machine defects related to the fault codes. It is also known, as disclosed in U.S. Pat. No. 5,533,193 to save data related to given machine events by selectively setting the control to respond to the occurrence of a given machine fault or event, monitoring the operation of the machine for the occurrence of the given machine event, and initiating the transfer of the data in a buffer to a non-volatile memory.

It is also known to be able to monitor the operation of a machine from a remote source by use of a powerful host computer having advanced, high level diagnostic capabilities. These systems have the capability to interact remotely with the machines being monitored to receive automatically initiated or user initiated requests for diagnosis and to interact with the requesting machine to receive stored data to enable higher level diagnostic analysis. Such systems are shown in U.S. Pat. Nos. 5,038,319, and 5,057,866 owned by the assignee of the present invention. These systems employ Remote Interactive Communications to enable transfer of selected machine operating data (referred to as machine physical data) to the remote site at which the host computer is located, through a suitable communication channel. The machine physical data may be transmitted from a monitored document system to the remote site automatically at predetermined times and/or response to a specific request from the host computer.

A difficulty with prior art diagnostic services is the inability to easily and automatically pinpoint the precise parts or subsystems in a machine causing a malfunction or deteriorating condition. It would be much more economical to be able to simply replace a part than to exert significant time and effort trying to correct or repair the part. This is the trend in today's high tech system environment. It would be desirable, therefore, to provide a highly intelligent, automated diagnostic system that provides an indication of the need to replace specific parts or subsystems rather than the need for extensive service troubleshooting to minimize machine downtime.

In copying or printing systems, such as a xerographic copier, laser printer, or inkjet printer, a common technique for monitoring the quality of prints is to artificially create a "test patch" of a predetermined desired density. The actual density of the printing material (toner or ink) in the test patch can then be optically measured to determine the effectiveness of the printing process in placing this printing material on the print sheet.

In the case of xerographic devices, such as a laser printer, the surface that is typically of most interest in determining the density of printing material thereon is the charge-retentive surface or photoreceptor, on which the electrostatic latent image is formed and subsequently, developed by causing toner particles to adhere to areas thereof that are charged in a particular way. In such a case, the optical device for determining the density of toner on the test patch, which is often referred to as a toner area coverage sensor or "densitometer", is disposed along the path of the photoreceptor, directly downstream of the development of the development unit. There is typically a routine within the operating system of the printer to periodically create test patches of a desired density at predetermined locations on the photoreceptor by deliberately causing the exposure system thereof to charge or discharge as necessary the surface at the location to a predetermined extent.

The test patch is then moved past the developer unit and the toner particles within the developer unit are caused to adhere to the test patch electrostatically. The denser the toner on the test patch, the darker the test patch will appear in optical testing. The developed test patch is moved past a densitometer disposed along the path of the photoreceptor, and the light absorption of the test patch is tested; the more light that is absorbed by the test patch, the denser the toner on the test patch. Xerographic test patches are traditionally printed in the interdocument zones on the photoreceptor. Generally each patch is about an inch square that is printed as a uniform solid half tone or background area. Thus, the traditional method of process controls involves scheduling solid area, uniform halftones or background in a test patch. Some of the high quality printers contain many test patches.

It would be desirable, therefore, to be able to use a simple toner area coverage sensor rather than a complex sensor system to provide machine data to be able to diagnose a machine and identify specific part or subsystem failures or malfunctions. It would also be desirable to provide a systematic, logical test analysis scheme to assess machine operation from a simple sensor system and to be able to pinpoint parts, components, and subsystems needing replacement.

It is an object of the present invention, therefore, to provide a new an improved technique for machine diagnosis, in particular, to be able to identify precise components or parts for replacement to maintain machine operation. It is another object of the present invention to provide a highly intelligent, automated diagnostic system that identifies the need to replace specific parts rather than the need for extensive service troubleshooting to minimize machine downtime. It is still another object of the present invention to provide a systematic, logical test analysis scheme to assess machine operation from a simple sensor system and to be able to pinpoint parts and components needing replacement.

Other advantages of the present invention will become apparent as the following description proceeds, and the features characterizing the invention will be pointed out with particularity in the claims annexed to and forming a part of this specification.

SUMMARY OF THE INVENTION

The invention includes a highly intelligent, automated diagnostic system that identifies the need to replace specific parts to minimize machine downtime rather than require extensive service troubleshooting. In particular, a systematic, logical test analysis scheme to assess machine operation from a simple sensor system and to be able to pinpoint parts and components needing replacement is provided by a series of first level of tests by the control to monitor components for receiving a first level of data and by a series of second level of tests by the control to monitor components for receiving a second level of data. Each of the first level tests and first level data is capable of identifying a first level of part failure independent of any other test. Each of the second level tests and second level data is a combination of first level tests and first level data or a combination of a first level test and first level data and a third level test and third level data. The second level tests and second level data are capable of identifying second and third levels of part failure. Codes are stored and displayed to manifest specific part failures.

DETAILED DESCRIPTION OF THE DRAWINGS

For a better understanding of the present invention, reference may be had to the accompanying drawings wherein the same reference numerals have been applied to like parts and wherein.

Figure 10:
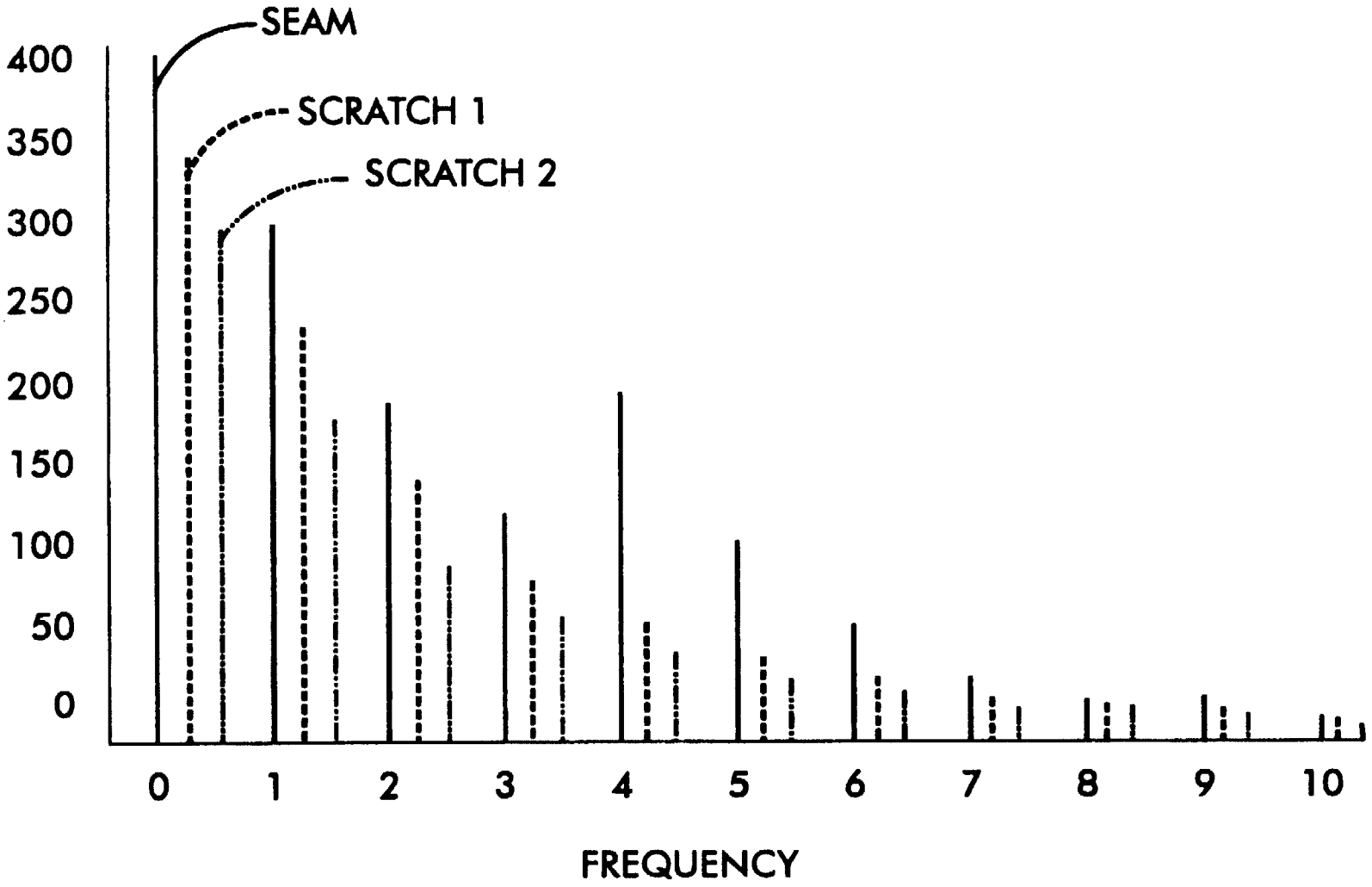
Figure 11:
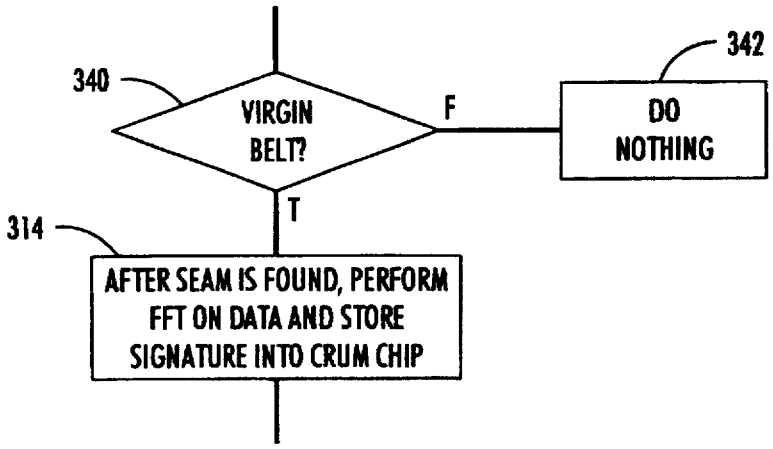
Figure 12:
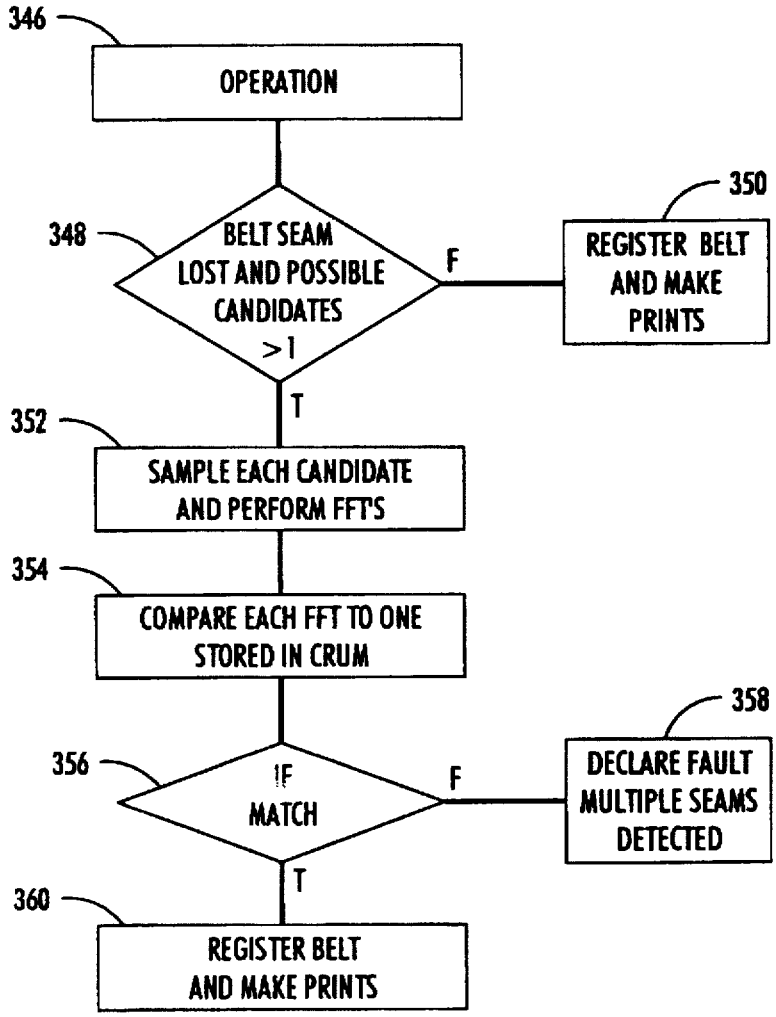
Figure 13:
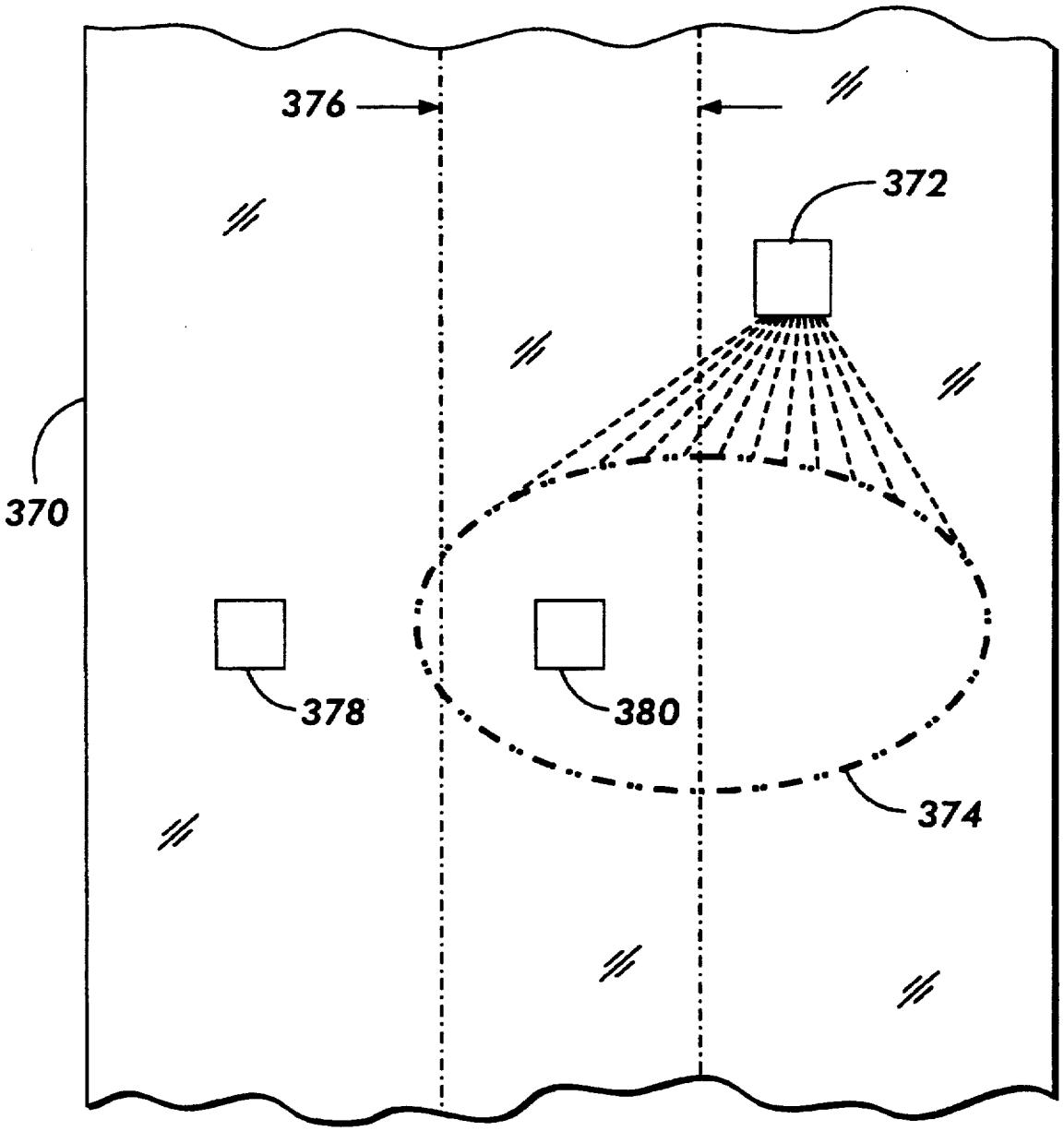

FIGS. 10, 11, and 12 show seam signature analysis in accordance with the present invention; and FIG. 13 illustrates outgassing deterioration detection in accordance with the present invention.

DETAILED DESCRIPTION OF THE PREFERRED EMBODIMENT

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
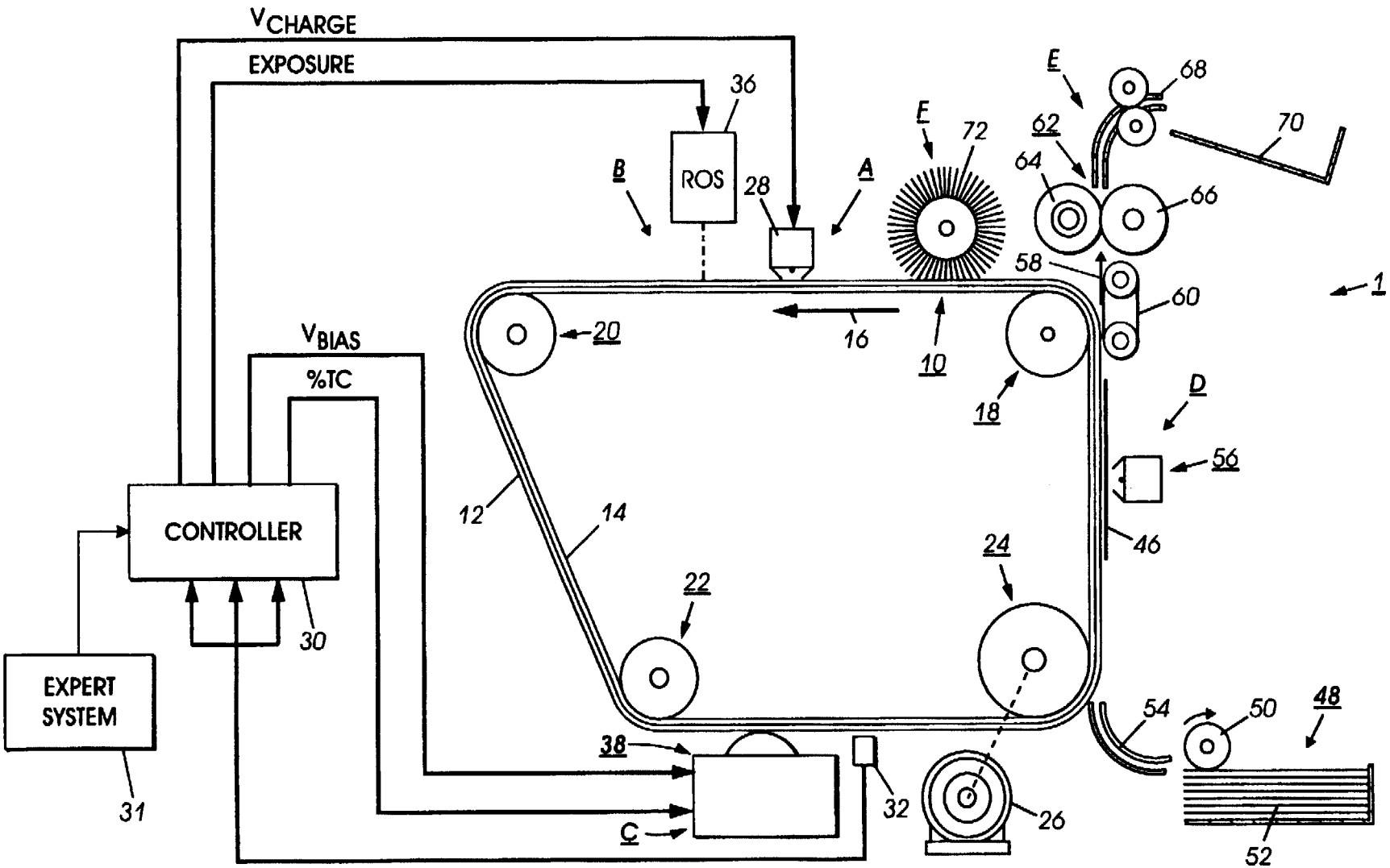
FIG. 1 is an elevational view illustrating a typical electronic imaging system incorporating a technique of fault isolation and part replacement in accordance with the present invention.

Turning to FIG. 1, the electrophotographic printing machine 1 employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22, 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28 charges a portion of photoconductive surface 12 of belt 10 to a relatively high, substantially uniform potential.

Next, the charged portion of photoconductive surface 12 is advanced through exposure station B. At exposure station B, a Raster Input Scanner (RIS) and a Raster Output Scanner (ROS) are used to expose the charged portions of photoconductive surface 12 to record an electrostatic latent image thereon. The RIS (not shown), contains document illumination lamps, optics, a mechanical scanning mechanism and photosensing elements such as charged couple device (CCD) arrays. The RIS captures the entire image from the original document and coverts it to a series of raster scan lines. The raster scan lines are transmitted from the RIS to a ROS 36.

ROS 36 illuminates the charged portion of photoconductive surface 12 with a series of horizontal lines with each line having a specific number of pixels per inch. These lines illuminate the charged portion of the photoconductive surface 12 to selectively discharge the charge thereon. An exemplary ROS 36 has lasers with rotating polygon mirror blocks, solid state modulator bars and mirrors. Still another type of exposure system would merely utilize a ROS 36 with the ROS 36 being controlled by the output from an electronic subsystem (ESS) which prepares and manages the image data flow between a computer and the ROS 36. The ESS (not shown) is the control electronics for the ROS 36 and may be a self-contained, dedicated minicomputer. Thereafter, belt 10 advances the electrostatic latent image recorded on photoconductive surface 12 to development station C.

One skilled in the art will appreciate that a light lens system may be used instead of the RIS/ROS system heretofore described. An original document may be positioned face down upon a transparent platen. Lamps would flash light rays onto the original document. The light rays reflected from original document are transmitted through a lens forming a light image thereof. The lens focuses the light image onto the charged portion of photoconductive surface to selectively dissipate the charge thereon. The records an electrostatic latent image on the photoconductive surface which corresponds to the informational areas contained within the original document disposed upon the transparent platen.

At development station C, magnetic brush developer system, indicated generally by the reference numeral 38, transports developer material comprising carrier granules having toner particles adhering triboelectrically thereto into contact with the electrostatic latent image recorded on photoconductive surface 12. Toner particles are attracted form the carrier granules to the latent image forming a powder image on photoconductive surface 12 of belt 10.

After development, belt 10 advances the toner powder image to transfer station D. At transfer station D a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feedroll 50 contacting the uppermost sheet of a stack of sheets 52. Feed roll 50 rotates to advance the uppermost sheet from stack 50 into sheet chute 54. Chute 54 directs the advancing sheet of support material 46 into a contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 driven by a motor and a backup roller 66. Sheet 46 passes between fuser roller 64 and backup roller 66 with the toner powder image contacting fuser roll 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a preclean corona generating device (not shown) and a rotatably mounted preclean brush 72 in contact with photoconductive surface 12. The preclean corona generator neutralizes the charge attracting the particles to the photoconductive surface. These particles are cleaned from the photoconductive surface by the rotation of brush 72 in contact therewith. One skilled in the art will appreciate that other cleaning means may be used such as a blade cleaner. Subsequent to cleaning, a discharge lamp (not shown) discharges photoconductive surface 12 with light to dissipate any residual charge remaining thereon prior to the charging thereof for the next successive imaging cycle.

A control system coordinates the operation of the various components. In particular, controller 30 responds to sensor 32 and provides suitable actuator control signals to corona generating device 28, ROS 36, and development system 38 which can be any suitable development system such as hybrid jumping development or a mag brush development system. The actuator control signals include state variables such as charge voltage, developer bias voltage, exposure intensity and toner concentration the controller 30 includes an expert system 31 including various logic routines to analyze sensed parameters in a systematic manner and reach conclusions on the state of the machine. Changes in output generated by the controller 30, in a preferred embodiment, are measured by a toner area coverage (TAC) sensor 32. TAC sensor 32, which is located after development station C, measures the developed toner mass for difference area coverage patches recorded on the photoconductive surface 12. The manner of operation of the TAC sensor 32, shown in FIG. 1, is described in U.S. Pat. No. 4,553,003 which is hereby incorporated in its entirety into the instant disclosure. TAC sensor 32, is an infrared reflectance type densitometer that measures the density of toner particles developed on the photoconductive the surface 12.

Figure 2:
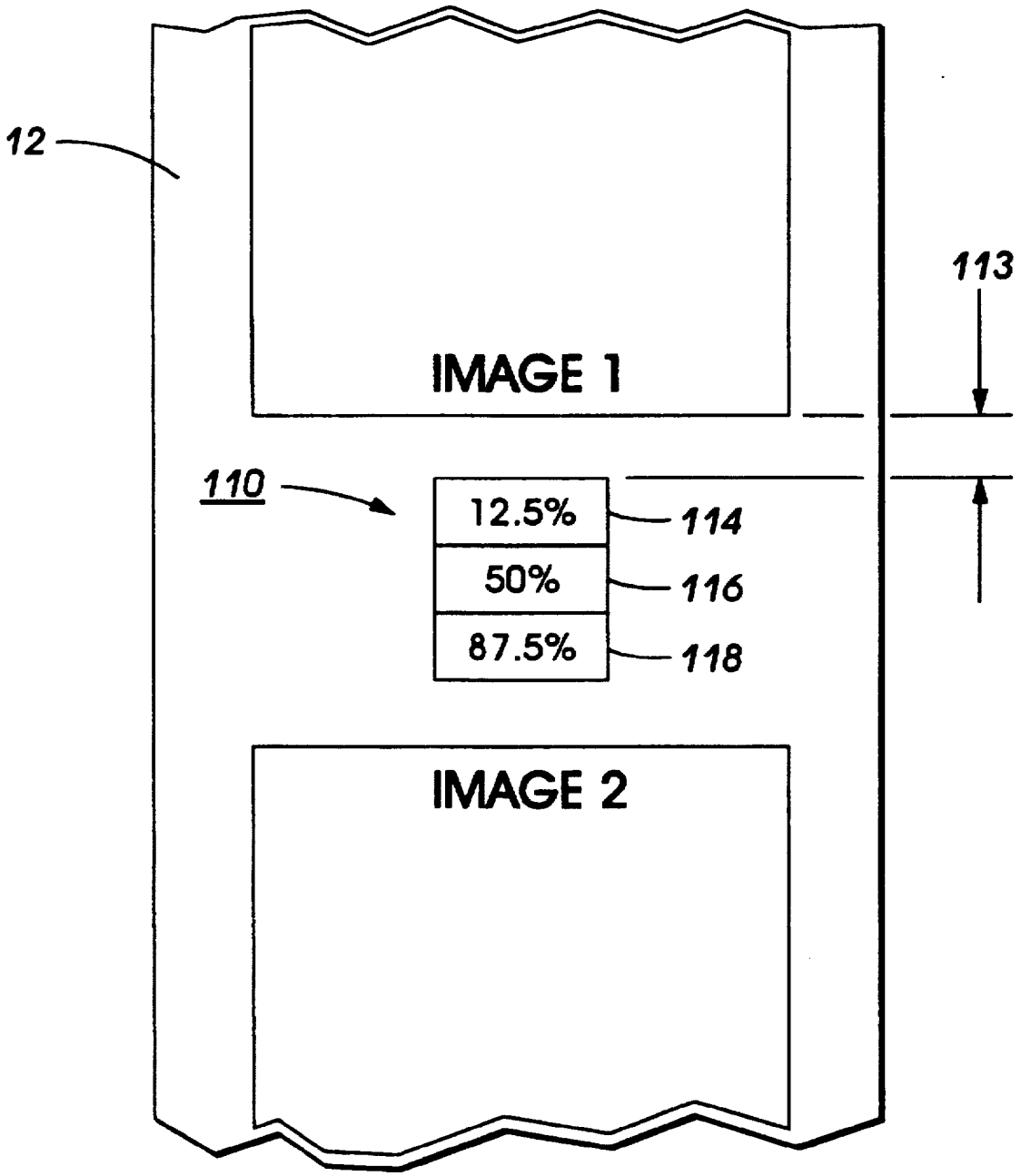
FIG. 2 illustrates the generation of control test patches for use with a toner area coverage sensor.

Referring to FIG. 2, there is illustrated a typical composite toner test patch 110 imaged in the interdocument area of photoconductive surface 12. The photoconductive surface 12, is illustrated as containing two documents images image 1 and image 2. The test patch 110 is shown in the interdocument space between image 1 and image 2 and in that portion of the photoconductive surface 12 sensed by the TAC sensor 32 to provide the necessary signals for control. The composite patch 110, in a preferred embodiment, measures 15 millimeters, in the process direction, and 45 millimeters, in the cross process direction and provides various halftone level patches such as an 87.5% patch at 118, a 50% halftone patch at 116 and a 12.5% halftone patch at 114.

Before the TAC sensor 32 can provide a meaningful response to the relative reflectance of patch, the TAC sensor 32 must be calibrated by measuring the light reflected from a bare or clean area portion 112 of photoconductive belt surface 12. For calibration purposes, current to the light emitting diode (LED) internal to the TAC sensor 32 is increased until the voltage generated by the TAC sensor 32 in response to light reflected from the bare or clean are 112 is between 3 and 5 volts.

It should be understood that the term TAC sensor or "densitometer" is intended to apply to any device for determining the density of print material on a surface, such as a visible-light densitometer, an infrared densitometer, an electrostatic voltmeter, or any other such device which makes a physical measurement from which the density of print material may be determined.

Figure 3:
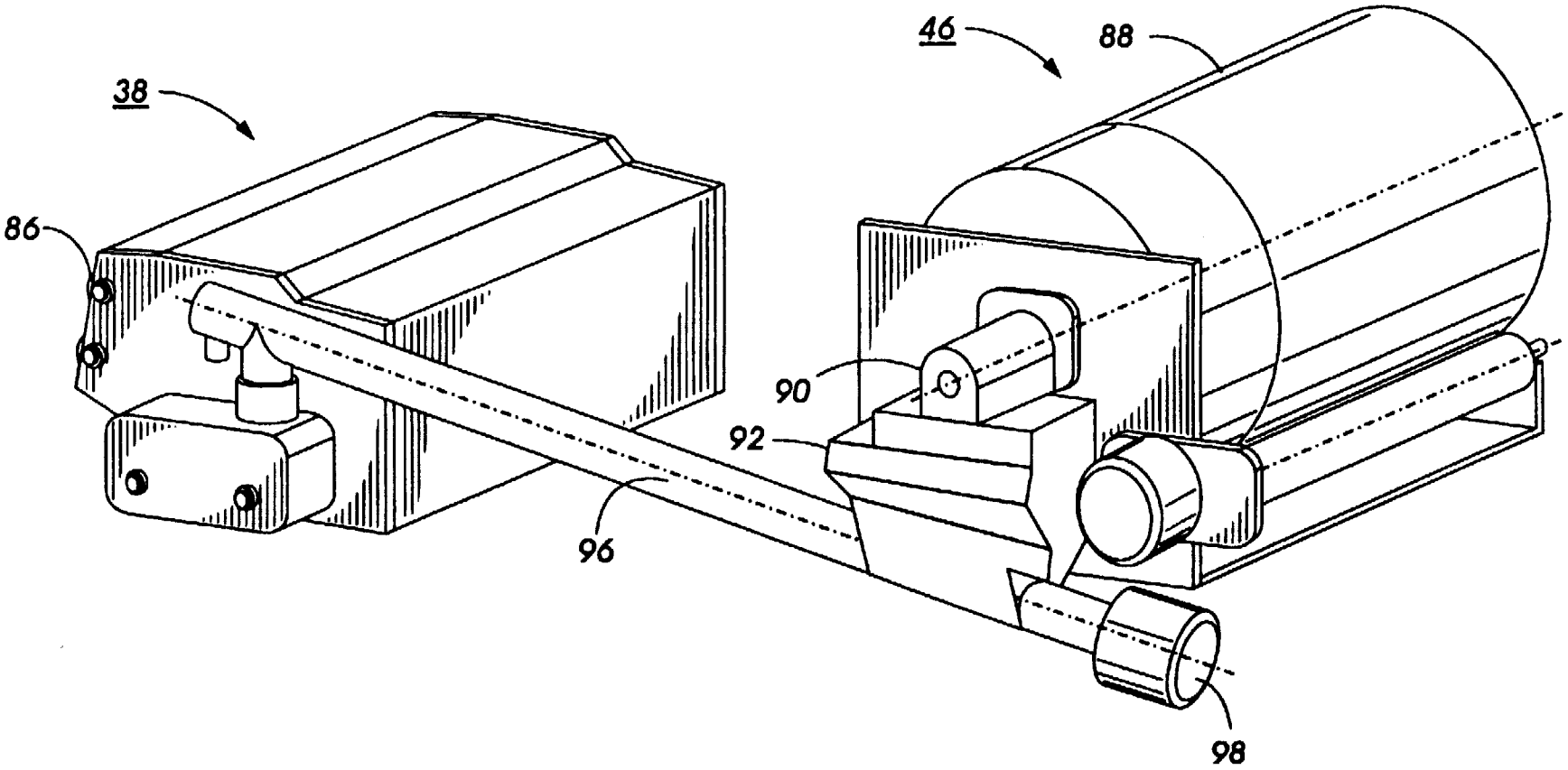
FIG. 3 shows a typical developer and toner dispense system.

FIG. 3 shows in greater detail developer unit 38 illustrated in FIG. 1. The developer unit includes a developer 86 which could be any suitable development system, such as hybrid jumping development or mag brush development, for applying toner to a latent image. The developer is generally provided in a developer housing and the rear of the housing usually forms a sump containing a supply of developing material. A (not shown) passive crossmixer in the sump area generally serves to mix the developing material.

The developer 86 is connected to a toner dispense assembly shown at 46 including a toner bottle 88 providing a source of toner particles, an extracting auger 90 for dispensing toner particles from bottle 88, and hopper 92 receiving toner particles from auger 90. Hopper 92 is also connected to delivery auger 96 and delivery auger is rotated by drive motor 98 to convey toner particles from hopper 92 for distribution to developer 86. It should be understood that a developer or toner dispense assembly could be individual replacement units or a combined replacement unit.

Figure 4:
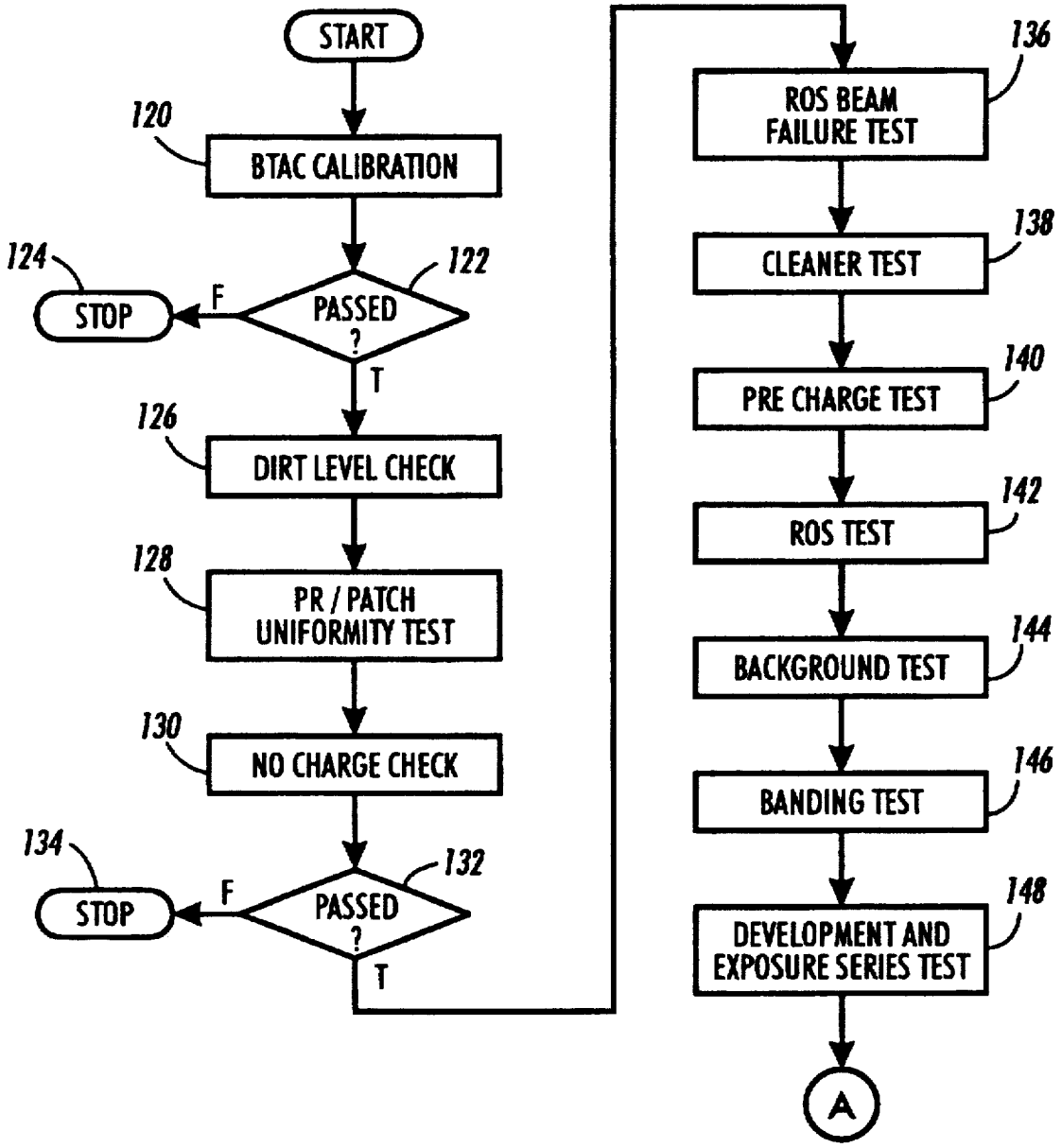
FIGS. 4 and 5 are a general flow chart illustrating a general technique for fault isolation in accordance with the present invention.
Figure 5:
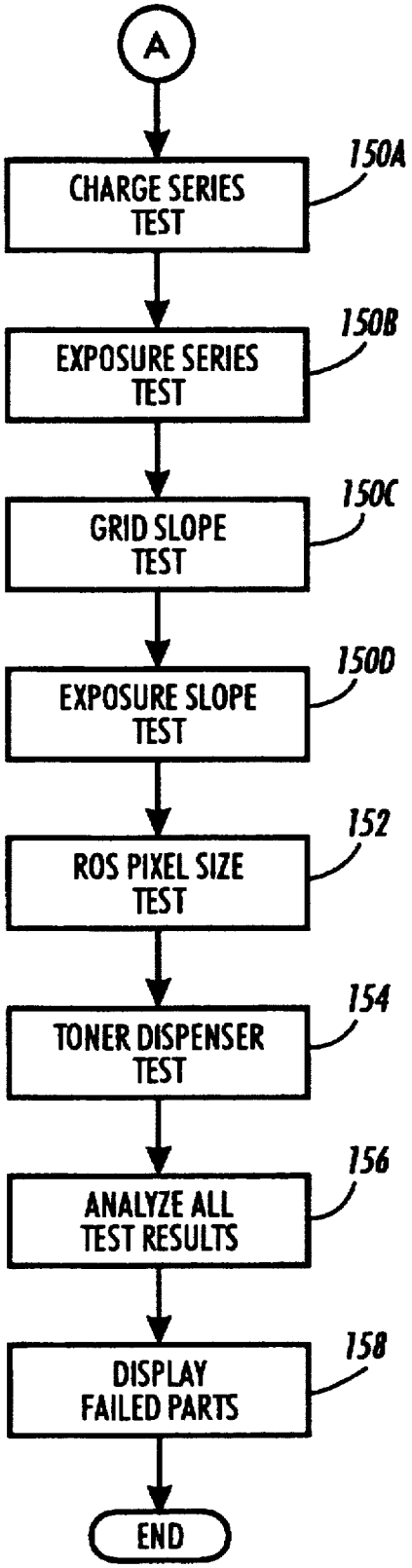

With reference to FIGS. 4 and 5, a series of tests, both stand alone and cumulative, logically analyze test results to determine any parts or subsystems needing replacement. These tests are based upon readings of selective test patches by a toner area coverage sensor. The underlying basis of the system is that it is cheaper and quicker to replace a part rather than spending valuable service time trying to correct or repair a part or subsystem at the customer's site. In particular, there is provided a highly intelligent, fully automated xerographic diagnostic routine that has the ability to inform the service representative that a specific part or parts need to be replaced. This task was accomplished by designing a series of individual tests that when performed in a logical manner and their results analyzed according to specific paradigms, the net result would point to the failure of one or more individual subsystems within the xerographic engine.

Some of the tests themselves are and could be used as stand alone diagnostic routines. They consist mainly of reading of various halftone and solid area patches by the process control sensors (BTAC, ESV, etc.) created under specific xerographic conditions usually in a before and after situation. The system analyzes the data using highly sophisticated tools (statistic packages, FFT's, etc.), looks at trends and obtains a result. It then combines this result with the results of various other tests and extracts logical conclusions as to the health of a specific subsystem.

For example: to test the cleaning subsystem, it may be necessary to concatenate the results of tests A, C, D, & F. For this test, A and D may be weighted more than C and F. The final result is that the cleaner test has some value of 60 with a variance of +/−8%. The failure mode may be >65 (+/−5%). In this instance the cleaning subsystem would have failed.

There is an analysis of all the various test combinations for each part that it needs to interrogate and obtains a parts to replace code. This code is then readily available to be accessed by the service rep either over the phone line or through the portable workstation (PWS). When displayed, a corresponding list of part or parts to replace is presented which relates back to the code. This system will run automatically when certain conditions are met within the process control system or can be called by the operator through the UI or the service rep through the PWS.

It should also be noted that the xerographic engine can be instructed from a remote site to run a setup when needed or to run a diagnostic self analysis routine and return via the phone line any pertinent results and/or parts to replace. Upon receiving the remote command, the xerographic subsystem goes off line, runs the appropriate routine and then returns to a ready state and conveys any information back to the calling center.

In modern xerographic print engines, process controls uses a variety of reflective sensors to monitor and control the tone reproduction curve of the xerographic process. One such sensor is the BTAC (Black Toner Area Coverage) sensor. In a final test for proper operation, the BTAC must be calibrated to the bare reflectance (absence of toner) of the photoreceptor. To achieve this, the output of an LED in the sensor is pulsed (stepped) until a certain analog voltage or level of reflectance is attained. This calibration process is continually repeated.

The process control system continuously monitors the state of the xerographic process. Sensors read various halftone patches which are an indication of the quality of the developed image. If the patch quality is not within range, changes are made to various actuators to bring the process back to center. The soundness of the patch is highly effected by the uniform quality of the belt surface. A scratch or defect on the photoreceptor where the patches are produced can change the outcome of a patch read.

Therefore, a second test is to take samples of the entire photoreceptor surface with the Black Toner Area Coverage (BTAC) sensor every 1.5 mm. Using a seam detection algorithm, the seam samples are discarded, and an overall clean belt uniformity measurement is calculated. This value is used as a baseline. Since the seam location was found, the location of each process control patch and its related BTAC readings can be analyzed. The mean and variance are determined for each patch and compared to the baseline value. Through a statistical analysis, the uniformity of each location computed and compared to the baseline. The operator can then be informed to replace the belt if the uniformity was lower than an acceptable level.

Basic xerography is controlled by three subsystems; charge, exposure, and development such as Hybrid Jumping Development. In Discharge Area Development systems, one can develop an image with the absence of charge. This principle makes it possible to devise a logical method for determining certain failure modes of these three actuators.

The first step is to test the charging subsystem. Three different halftone patches (12%, 50%, and 87%) are produced using nominal settings for charge, exposure, and development. The reflectance of each patch is measured with the BTAC sensor. If the level of each patch is within a reasonable range, it is assumed that the charging system is working well. If each patch is measured to be very dark, it is deducted that the charging subsystem is malfunctioning. At this point, the method is halted, and charge is tagged to be faulted.

The second step (if charge is OK) creates a patch by turning off charge and exposure and enabling development. This will create a very dark patch. The level of this patch is measured by the BTAC and based upon the density, development component operability can be determined. The third step creates a patch using nominal charge, nominal development, and a very high exposure setting. This will create a very dark patch. The level of this patch is measured by the BTAC and based upon the density, exposure component operability can be determined.

As prints are produced, the developer subsystem needs to be continuously replenished with toner. This is achieved through a toner dispenser subsystem which consists of a dispense motor and a containment reservoir. This system can become inoperative when the motor fails (electrically loses power or the gears become jammed) or the auger within the containment reservoir becomes impacted with toner and binds up.

With respect to FIGS. 4 and 5, in block 120 the toner area coverage sensor, in this case, a black toner area coverage (BTAC) sensor is calibrated. A first level of determination is whether or not the sensor passes the calibration standard as shown in block 122, and if so, a next level test, a dirt level check is performed as shown in block 126. If the calibration determination in block 122 fails, the machine is stopped as illustrated in block 124.

After the dirt level check, there is a photoreceptor patch uniformity test as illustrated at block 128. In essence, this test checks for defective areas of a xerographic photoreceptor surface. The result of the previous test is to determine if there is an adequate charge provided by the system charging mechanism, as illustrated in block 130. If there is not an adequate charge, the system stops as shown at block 134. If there is adequate charge, as determined at block 132, a ROS beam failure test is conducted as shown in block 136. After the ROS beam failure test, a cleaner test is conducted as illustrated in block 138.

A more comprehensive actuator performance indicator test is illustrated in precharged test block 140 and ROS test 142 and shown in detail in the flow chart in FIGS. 9A and 9B. Following the actuator performance indicator tests, there is provided a background test illustrated in block 144 and a banding test illustrated in block 146. Following these tests as illustrated in block 148, there are provided a series of standard charge tests, exposure tests, grid slope tests, and exposure slope tests as illustrated in blocks 150A, 150B, 150C, and 150D. Upon the completion of these tests there is conducted a ROS pixel size test as illustrated in block 152. Also, there is a toner dispenser test illustrated in block 154. Finally, as illustrated in blocks 156 and 158, there is an analysis of all the test results and a display of failed parts.

Figure 6:
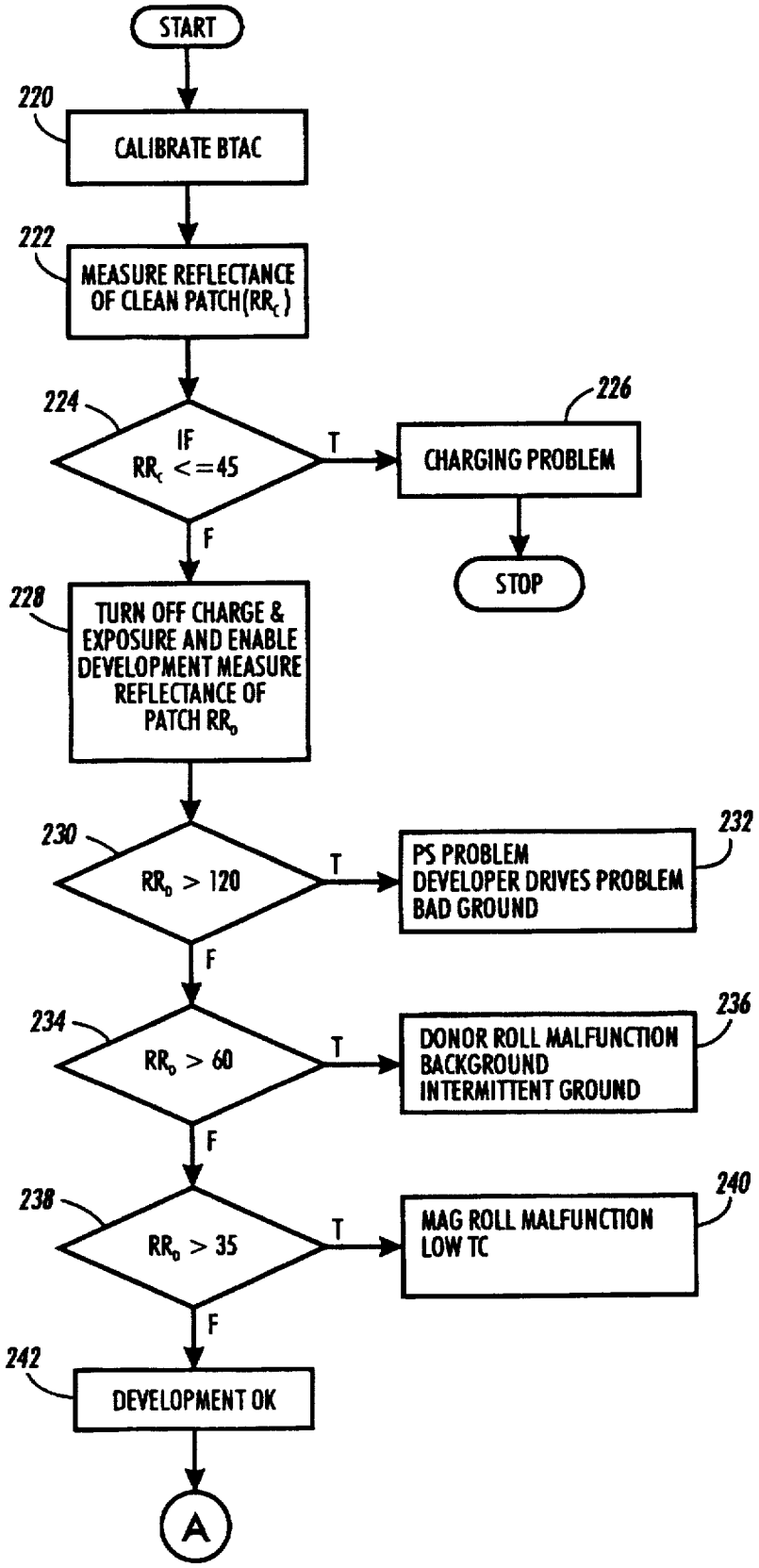
FIGS. 6 and 7 are a more detailed flow chart illustrating actuator performance indicators in accordance with the present invention.
Figure 7:
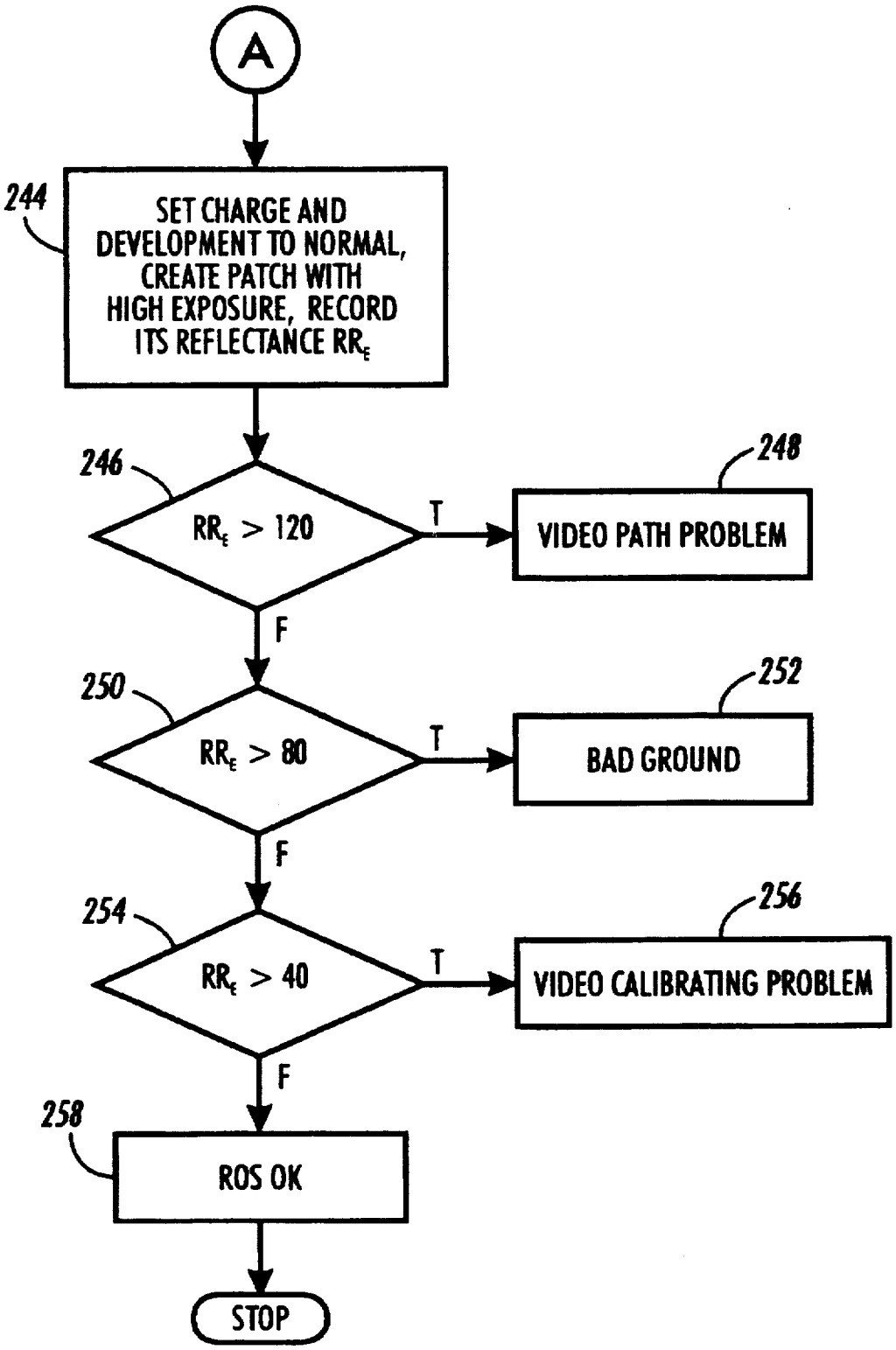

FIGS. 6 and 7 illustrate actuator performance indications. In particular, the calibration of the sensor is shown at block 220. Block 222 illustrates the measurement of the relative reflectance of a clean patch. If the relative reflectance of the patch is less than a given threshold, for example, 45, then there is an indication of a charging problem as shown in block 226. It should be noted that the numeral 45 represents a digitized sensor signal in the range of 0–255 and the number selected is a designed decision based upon machine characteristics. A relative reflectance signal less than 45 indicates very dark patches. If the relative reflectance is not less than 45, then as shown in block 228, the charge and exposure systems are turned off and the development unit enabled.

The relative reflectance of special patches are then measured, for example, a 12%, 50%, and 87% half tone patch. The half tone level of each patch is measured by the sensor. If the relative reflectance is greater than 120 as illustrated in block 230, indicating a very light response, then there is indicated a range of problems as illustrated in block 232. On the other hand, if the relative reflectance is less than 120 but greater than 60 as illustrated in decision block 234, indicating a dark to light response, then there is an indication of a set of malfunctions as illustrated in block 236. If the relative reflectance is less than 60 but greater than 35 as illustrated in block 238, indicating a dark response, then another set of problems are indicated as illustrated at block 240. Finally, if the relative reflectance is less than 35 indicating a very dark response, then no malfunction is indicated and the development system is operational as shown in block 242.

The next step is to set the charge and development to nominal to create a patch with a high exposure setting and determine the relative reflectance. As illustrated in block 246, if the relative reflectance digitized signal is greater than 120, indicating a light patch, a video path problem is indicated as shown in block 248. If the relative reflectance is less than 120 but greater than 80 as shown in block 250, indicating a dark to light patch, then there is determined a bad ground as shown in block 252. On the other hand, if the relative reflectance is less than 80 but greater than 40, a dark patch illustrated in block 254, there is an indication of a video cabling problem as shown in block 256. Finally, if the relative reflectance is less than 40, indicating a very dark patch, there is a determination of no malfunction with the ROS is system as shown in block 258.

Figure 8:
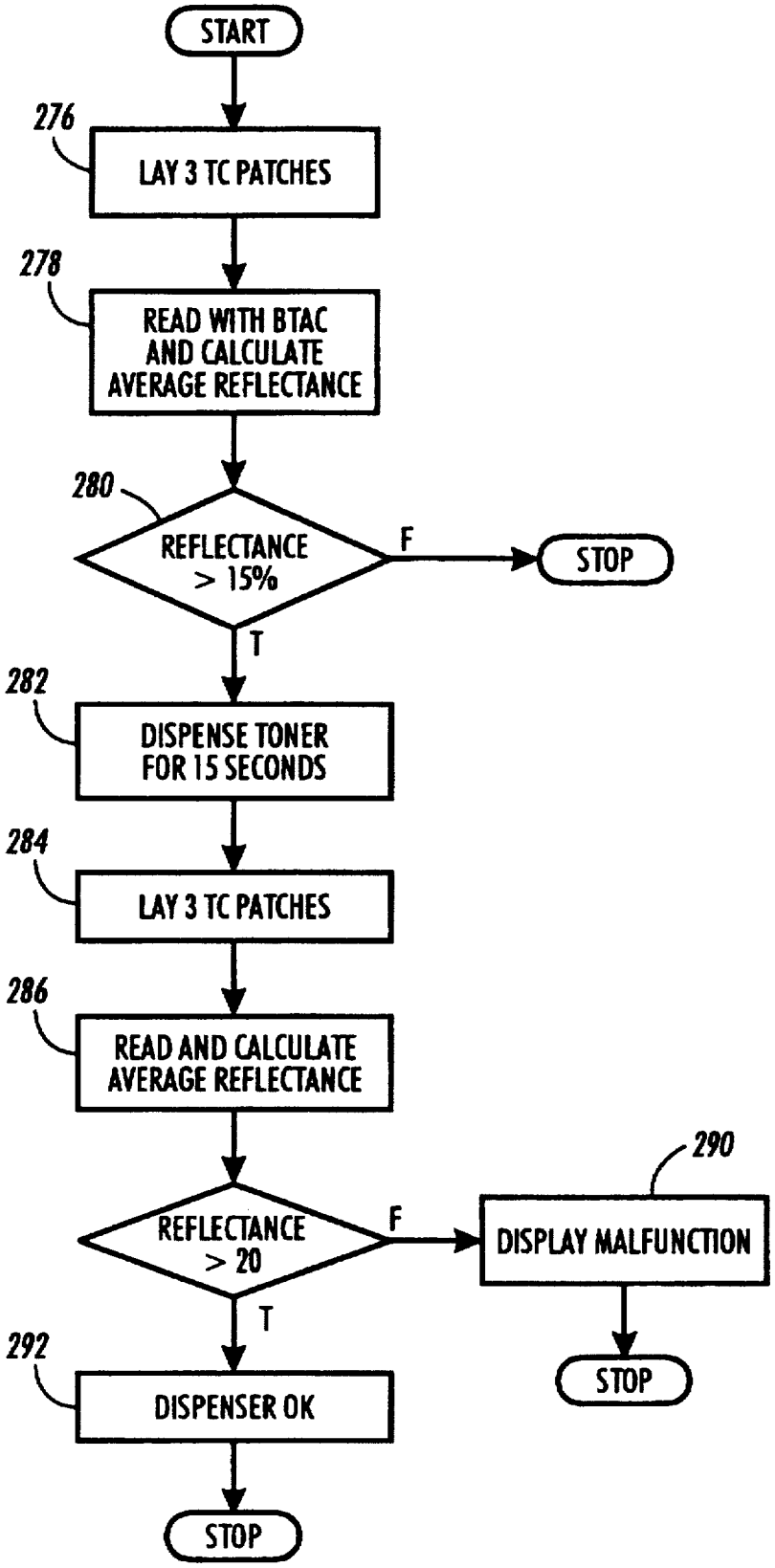
FIG. 8 is a more detailed flow chart illustrating the ROS pixel growth detector in accordance with the present invention.

With reference to FIG. 8, there is shown in the flow chart a technique to monitor toner dispense. In particular, three special toner concentration patches are provided on the photoreceptor surface as illustrated in block 276. The details of these three special patches are described in pending U.S. Ser. No. 926,476 (D/97101) filed Sep. 10, 1997, incorporated herein. The patches are read by the BTAC sensor and an average reflectance calculated as shown in block 278. If the reflectance with reference to a clean patch is greater than 15% as illustrated in decision block 280, then there is a determination of a normal toner concentration. However, if the average reflectance is less than 15%, then as illustrated in block 282, the tones dispense is activated for 15 seconds.

It should be noted that 15 seconds is a design choice and in one embodiment is the time for toner to get from a toner bottle dispenser on to the photoreceptor and sensed by the sensor. After activation of the toner dispenses for a given period of time, again three toner concentration patches are provided as illustrated at block 284. Again there is a sensing and calculation of the average reflectance as shown in block 286. If the reflectance is greater than 20 as illustrated in the decision block 288, then the dispenser is determined to be operational as shown in block 292. On the other hand, if the reflectance is 20 or less, there is a determination as shown in block 290 that there is a toner dispense malfunction. Further details of the above technique are described in D/97607 (U.S. Ser. No. 035,129), D/97608 (U.S. Ser. No. not assigned yet), D/97609 (U.S. Ser. No. 035,124), D/97610 (U.S. Ser. No. 035,126), and D/97614 (U.S. Ser. No. 034,900) incorporated herein.

In modern xerographic print engines, as developer material sits idle for a long period of time (24 hours or more), the charge between the developer material particles (developer and carrier) becomes weak. This weakness is aggravated even more when the humidity increases. The net effect is that the initial copies produced become darker than expected. This results in poor copy quality.

In accordance with this invention, there is a technique to determine when this condition has occurred. This is accomplished by an automatic rest recovery method which would revitalize the material without any operator invention. First the amount of rest time is monitored. The rest time is the time between cycle ups of the xerographic engine. When the rest time reaches a specific threshold, the machine will go off line and cycle up the xerographic subsystem. It then develops two halftone parches (12% and 87%). The reflectance of these two patches is read by the Black Toner Area Coverage (BTAC) sensor and recorded. The difference between the two patches (12%–87%) is calculated. This difference is a good indicator that the patches have become too dark. If the delta is less than a target value, the tribo is considered to be within acceptable range and nothing is done. If the delta is greater than a target value the engine proceeds to perform a special rest recovery setup. This setup initially tones up and tones down the system enough to increase the tribo and rejuvenate the material. It then continues with the regular setup steps of toner concentration setup and electrostatic convergence. Once completed the system goes back on line and is ready to produce good copy quality.

In accordance with another aspect of this invention, it is desirable to rejuvenate the toner component of developer material upon installation of a new developer module. This is a one time procedure that precedes the rest recovery procedure described above. The procedure is as follows. All Xerographic control factors are set to machine nominal. Exposure is increase or decreased until a high density control target relative reflectance value is within a given range. If the target cannot be met and exposure goes out of range a fault is declared. The fault indicates a serious manufacturing or machine assembly problem. When the high density target is achieved a tone down starts. Tone down proceeds for 100 belt pitches at a 25% target area coverage. The tone down reduces the toner concentration by 2.5%.

When tone down is complete, tone up starts. Tone up proceeds at a toner dispenser 30% duty cycle rate for 50 belt pitches. Thru-put is at 5% area coverage. After tone up the procedure is completed. Testing shows that the developer toner tribo is increased in inverse proportion to its starting point. I.E. if the tribo is very low (8 uC/gm) then the break in procedure will increase it to about (16 uC/gm). If the tribo is high (20 uC/gm) then the break in procedure will increase it to (22 uC/gm).

The above procedure is explained in more detail with reference to FIG. 9.

Figure 9:
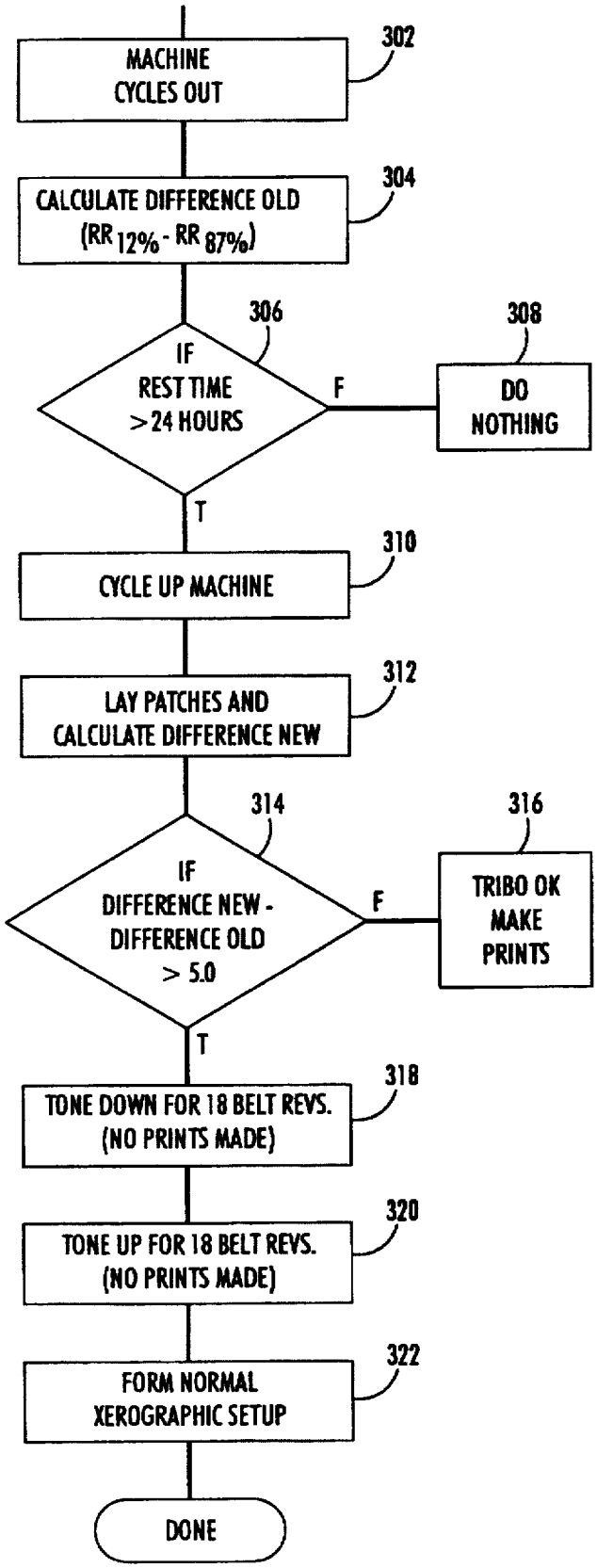
FIG. 9 illustrates tribo decay recovery in accordance with the present invention.

In FIG. 9 a machine cycle out is shown at block 302. Block 304 illustrates the calculation of a difference in measurement in the sensing of a 12% halftone target and an 87% halftone target that was previously done and stored in memory. Block 306 illustrates a decision as to whether or not the machine rest time is greater than 24 hours. If not, then no adjustment is required, as shown at block 308. If the rest time is greater than 24 hours, then at machine cycle up shown at block 310, the target patches are developed on the machine and a calculation of a new difference value shown in block 312. It should be noted that the rest time period of 24 hours is a mere design choice and the density value of the test targets is also a mere design choice and the scope of the present invention is intended to cover any number of suitable choices of parameters and testing devices. A comparison is made of the new difference and the old difference values. If the difference is greater than a suitable level such as 5, then a procedure of tone down or toner purge is activated as shown in block 318. If the comparison is not greater than 5 or some suitable value, then the tribo is considered satisfactory for the making of prints, as shown in block 316. In block 318 for 18 belt revolutions, toner is delivered out of the toner housing and cleaned off the belt to rid the system of old toner. Then, as illustrated in block 320, toner is dispensed into the system for a period of 18 belt revolutions, again no prints being made during this operation. It should be understood that the number of belt revolutions or the time for tone down or tone up is any suitable design choice. With the completion of the tone up at block 320, the system is then ready to initiate normal xerographic setup procedures as shown in block 322. For materials break-in for a new developer housing, the procedure is similar to the procedure above. A major difference is the number of belt revolutions for tone down and tone up. In a preferred embodiment, for a new developer material housing break-in, on a given machine, 50 belt revolutions is considered satisfactory.

In modern xerographic print engines, seam detection is a method employed to obtain proper positioning of images on the photoreceptor using an analog process control sensor. The sensor (a Toner Area Coverage Sensor) takes very finely spaced analog samples in the seam area which generates a curve with a given area. The center of moment is then calculated which in reality is the center of the seam. In operation, over the life of the photoreceptor, its surface can become scratched. This scratching can fool the seam detection system by making it appear that there are multiple seams on the belt.

The thrust of this aspect of the invention is to assign a unique identifiable signature to the seam which could easily be discernible from scratches. Since the data for finding the seam is in the shape of a wave form, a Fourier Transform of the wave produces a unique signature for each seam differing from those obtained from scratches. The procedure first captures this signature when a new photoreceptor is placed into the machine.

In this state, the belt's surface is free of any scratches and the only signal present on the belt is that of the seam. A new belt is detected since the belt is housed in a CRU (Customer Replaceable Unit) equipped with a EPROM that informs the system that it is a new CRU. The seam is then sampled and a FFT, Fast Fourier Transform, is performed on the wave form and the frequency distribution (its signature) is stored in the machine's nonvolatile memory.

Then, if one or more scratches appear as possible seams, a comparison is made between the stored seam signature and the other signatures. A match between the stored signature and a possible seam signature determines which candidate is the actual seam. FIG. 10 illustrates a typical comparison and FIGS. 11 and 12 illustrates the procedure in more detail.

With reference to FIG. 10, there is illustrated the wave forms representing a valid seam, a 2 millimeter surface scratch, and a 1 millimeter surface scratch. The seam is shown as a straight vertical line, the scratches as dashed vertical lines. With reference to FIG. 11, the block 340 is a decision block to determine whether or not the photoreceptor surface is a virgin surface or an older surface. If it is an old surface, then as shown at block 342, no further action is required. However, if it is a new surface, the first step as illustrated in block 344 is to find the seam and perform an FFT on the seam to provide a signature wave form to be stored in memory. Therefore, as shown in FIG. 12, when the machine is in operation, decision block 348 recognizes that the seam of the belt may be unaccounted for. If accounted for, then the belt is registered and the machine operated as shown in block 350. However, if there is confusion as to the location of the surface seam, then as shown in block 352 it is necessary to sample imperfections that may be the seam by performing Fourier Transforms. In block 354 each Fourier Transform is compared to the signature stored in memory. If there is a match as determined by decision block 356, the surface is registered to the seam as indicated by the match and the machine continues operation. If there is no match, indicating possible multiple seams are detected, a fault is declared as illustrated in block 358.

In modern xerographic print engines, the level of toner concentration greatly affects copy quality. As toner is consumed, it must be replenished by the dispense system in the proper proportion to maintain copy quality. Most system use a special magnetic toner control sensor to measure the relative concentration of toner. However, to reduce machine case, the toner concentration sensor is expendable if other methods can be employed.

The thrust of this aspect of the invention is a method to enable a toner concentration control system and thus eliminate a toner concentration sensor. This is accomplished with an abstract pixel counting sensor. The sensor extracts the pixel count (total number of pixels used per image) from the Raster Output Scanner (ROS) hardware and the control calculates the amount of toner consumed by the image. It then determines the amount of time the dispenser needs to run to replenish the used developer material. Also, a process control system monitors the reflectance of an 87% control patch with the Black Toner Area Coverage (BTAC) sensor.

The deviation from a target, a +/− error, is calculated and a proportional dispense period is determined based on a gain factor. This +/− dispense time is then sent to the toner dispenser subsystem and acted on appropriately. A special toner control patch is also created (mostly used for setup purposes) and developed upon the cycle out of the xerographic engine. This patch is read by the BTAC and acted on in approximately the same way as the 87% patch. The only differences are that the average area coverage of the job run is weighted into the dispense algorithm along with its own gain factor. The +/− dispense time is then sent to the toner dispenser subsystem for suitable action.

In modern xerographic print engines which contain a photoreceptor belt, a deletion prone area (loss of development) may occur in the locale of the charge scorotron due to out gassing of nitric oxide. When this occurs, developability is lost and the image can become degraded. In accordance with this aspect of the invention the process control system compares the reflectance uniformity of the suspected area with that of an area where no deletion could exist. Xerographic systems employ many belt parking schemes. But no matter what scheme is used, only certain areas of the belt will be parked under the scorotron and thus be influenced by its out gassing.

The system lays down a 50% halftone patch along the entire length of the belt in the process direction. The patch is sampled by the BTAC sensor in the known parking areas and an area outside the parking locations. The uniformity of these areas are calculated and compared (parked vs. non-parked). If any of the parked areas have a level far below that of the non-parked area it is concluded that a parking deletion exists and a status is displayed that the photoreceptor belt should be replaced.

With reference to FIG. 13, a photoreceptor or photosensitive surface 370 is disposed in a given relationship with respect to a charging device 372, the charging device emits gas that is harmful to that portion of the photosensitive surface disposed within the range of the emitted gasses. A given range is illustrated at 374 outlining a region that is effected by the gasses emitted by the charging device. To determine the degree of deterioration of portions of the photosensitive surface due to the out gasses, a patch or target strip 376 is developed along the length of the photosensitive surface. A portion of the photosensitive surface, illustrated at 378, outside of the region 374 is sensed and compared to a target patch 380 known to be influenced by the charging operation. Based upon the comparison, a determination is made as to whether the degree of deterioration is acceptable or requires a replacement of the photosensitive surface. It should be understood that portions of the photosensitive surface that are positioned or "parked" near the charging device 372 tend to be more seriously effected. The key to the technique is to lay down a target patch 376 that will clearly be within the range of the charging device 374. It should also be understood that one or several target patches 380 can be provided within the boundary 374 to be used to compare with the non-effected target patch 378.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In a machine producing pixel images and having a toner dispense mechanism, a method of determining toner concentration in a xerographic subsystem of the machine comprising the steps of:

extracting a pixel count and determining toner consumption in the xerographic subsystem per image to determine a first toner dispense time to replace depleted toner, monitoring a standard toner test patch and based upon a deviation from a standard, calculating a plus or minus second toner dispense time, developing a special toner test patch developed upon machine cycle out to determine a plus or minus third toner dispense time, and responding to the first, second, and third toner dispense times to activate the toner dispense mechanism.

2. The method of claim 1 wherein the standard toner test patch is an 87% halftone test patch measured by a toner area coverage sensor.

3. The method of claim 1 wherein the special toner test patch is measured by a toner area coverage sensor.

4. The method of claim 1 wherein the special toner test patch includes first and second test targets.

5. The method of claim 4 wherein the step of developing a special toner test patch includes the steps of comparing a difference between a reflectance value of the first and second test targets to a reference value to provide an error value and responding to the error value to determine a time period of dispense.

6. The method of claim 5 including the step of subtracting the reflectance value of the first test target from the reflectance value of the second test target.

7. The method of claim 5 wherein the first test target has a relatively low reflectance and the second test target has a medium reflectance.

8. The method of claim 5 wherein the first test target has an approximately 12.5% reflectance and the second test target has an approximately 50% reflectance.

9. In a machine producing pixel images and having a toner dispense mechanism, a method of determining toner concentration in a xerographic subsystem of the machine comprising the steps of:

determining toner consumption in the xerographic subsystem per image for a first toner dispense factor, sensing a standard toner test patch for deviation from a standard for a second toner dispense factor, developing a test patch combination for a third toner dispense factor, and responding to the first, second, and third toner dispense factors to activate the toner dispense mechanism.

10. The method of claim 9 wherein the step of determining toner consumption in the xerographic subsystem per image includes the step of extracting a pixel count per image.

11. The method of claim 9 wherein the step of sensing a standard toner test patch includes the step of determining a deviation from a standard and calculating a plus or minus toner dispense time.

12. The method of claim 9 wherein the step of developing a special toner test patch includes the steps of comparing a difference between a reflectance value of first and second test targets to a reference value to provide an error value and responding to the error value to determine a time period of dispense.

13. The method of claim 12 including the step of subtracting the reflectance value of the first test target from the reflectance value of the second test target.

14. The method of claim 13 herein the first test target has a relatively low reflectance and the second test target has a medium reflectance.

* * * * *